US008794908B2

(12) United States Patent
Dezouche et al.

(10) Patent No.: US 8,794,908 B2
(45) Date of Patent: Aug. 5, 2014

(54) STATOR STAGE FOR TURBOMACHINE COMPRESSOR

(75) Inventors: Laurent Gilles Dezouche, Le Coudray Monceau (FR); Patrick Edmond Kapala, Villevaude (FR)

(73) Assignee: Snecma, Paris (FR)

( * ) Notice: Subject to any disclaimer, the term of this patent is extended or adjusted under 35 U.S.C. 154(b) by 601 days.

(21) Appl. No.: 13/074,705

(22) Filed: Mar. 29, 2011

(65) Prior Publication Data

US 2011/0243742 A1 Oct. 6, 2011

(30) Foreign Application Priority Data

Mar. 30, 2010 (FR) ..... 10 01296

(51) Int. Cl.
*F01D 25/06* (2006.01)

(52) U.S. Cl.
USPC ..... 415/119; 415/191; 415/209.4; 415/210.1

(58) Field of Classification Search
USPC ..... 415/119, 191, 209.4, 210.1, 211.2
See application file for complete search history.

(56) References Cited

U.S. PATENT DOCUMENTS

| | | | | |
|---|---|---|---|---|
| 3,708,242 | A * | 1/1973 | Bruneau et al. | 415/209.4 |
| 4,452,564 | A | 6/1984 | Conant et al. | |
| 4,832,568 | A | 5/1989 | Roth et al. | |
| 5,785,499 | A * | 7/1998 | Houston et al. | 416/248 |
| 7,147,434 | B2 * | 12/2006 | Mons et al. | 415/200 |
| 7,887,286 | B2 | 2/2011 | Abgrall et al. | |
| 2010/0054917 | A1 * | 3/2010 | Razzell | 415/119 |

FOREIGN PATENT DOCUMENTS

| | | | |
|---|---|---|---|
| EP | 1 291 492 | A1 | 3/2003 |
| EP | 2075415 | * | 7/2009 |
| FR | 1 426 559 | A1 | 6/2004 |
| FR | 1 493 901 | A1 | 1/2005 |
| FR | 2 075 415 | A1 | 7/2009 |
| WO | WO2009/083568 | * | 7/2009 |

OTHER PUBLICATIONS

Kalrez, DuPont Performance Elastomers, Sep. 14, 2009.*
Wayback Machine screen shot showing date of publication of Kalrez document. Screen shot taken Sep. 9, 2013.*
French Preliminary Search Report issued Nov. 11, 2010, in French 1001296, filed Mar. 30, 2010 (with English Translation of Category of Cited Documents).

* cited by examiner

*Primary Examiner* — Edward Look
*Assistant Examiner* — William Grigos
(74) *Attorney, Agent, or Firm* — Oblon, Spivak, McClelland, Maier & Neustadt, L.L.P.

(57) ABSTRACT

A turbomachine stator stage including two coaxial shrouds, respectively an inner shroud and an outer shroud with substantially radial vanes extending therebetween, the radially outer ends of the vanes being welded to the outer shroud and the radially inner ends of the vanes passing through orifices in an outer ring of the inner shroud, the inner ends being held by elastomer spacers in an annular cavity formed between the outer ring and an inner ring that is fastened to the outer ring.

13 Claims, 2 Drawing Sheets

STATOR STAGE FOR TURBOMACHINE COMPRESSOR

FIELD OF THE INVENTION

The present invention relates to a stator stage for a turbomachine compressor, in particular for a low-pressure or a high-pressure compressor of a turbomachine.

BACKGROUND OF THE INVENTION

A turbomachine compressor has at least one stator stage comprising two coaxial shrouds extending one inside the other with substantially radial vanes extending between them, which vanes are connected at their radial ends to the shrouds.

The outer shroud of a stator stage has radial orifices in which the radially outer ends of the vanes are engaged and fastened, generally by welding. The inner shroud of the stator stage has radial orifices in which the radially inner ends of the vanes are engaged with clearance.

In the prior art, the clearance between the inner ends of the vanes and the edges of the orifices in the inner shroud is occupied by a silicone-based polymerizable sealing resin that serves to provide mechanical connection between the vanes and the inner shroud. The resin is injected directly onto the inner ends of the vanes, over a thickness in the radial direction that is relatively large (a few millimeters) in order to embed the ends. The resin is relatively flexible and presents viscoelastic behavior, thereby enabling it to accommodate both positioning tolerances of the parts and relative movements due to thermal expansion in operation, while damping vibration and providing sealing at the inner ends of the vanes.

Nevertheless, that resin does not withstand temperatures higher than 250° C., and therefore cannot be used in a compressor for which the operating temperatures exceed 300° C. At present, there is no available resin or elastomer that is injectable onto the parts over a relatively large thickness and that withstands temperatures higher than 300° C.

OBJECT AND SUMMARY OF THE INVENTION

The present invention provides a solution to this problem that is simple, effective, and inexpensive.

An object of the present invention is to provide a stator stage for a low-pressure or high-pressure turbomachine compressor in which operating temperatures may exceed 300° C., or even 350° C.

To this end, the invention provides a stator stage of a turbomachine compressor, the stage comprising two coaxial shrouds, respectively an inner shroud and an outer shroud, having substantially radial vanes extending therebetween with the radially outer ends of the vanes being welded to the outer shroud and with the radially inner ends of the vanes being secured to the inner shroud by sealing and vibration-damping means, wherein the inner shroud comprises two coaxial rings fastened one inside the other, the outer ring having orifices for passing the inner ends of the vanes and co-operating with the inner ring to define an annular cavity for housing inter-vane spacers for providing sealing and for damping vibration, each of which spacers is mounted between the inner ends of two adjacent vanes and bears against said ends.

The inter-vane spacers provide mechanical connection, sealing, and vibration damping between the vanes and the inner shroud, and they replace the sealing resin used in the prior art. They are made of an elastically-deformable material such as an elastomer, so as to serve to damp the vibration to which the vanes are subjected in operation, and also to provide sealing at the inner ends of the vanes. Furthermore, the material is selected so as to withstand high temperatures, greater than 300° C. The inter-vane spacers are advantageously made of a perfluoroelastomer, e.g. of the FFKM type.

The present invention presents other advantages: the inter-vane spacers are removable and optionally replaceable during a maintenance operation, and they allow the vanes and the inner shroud of the stator stage to move relative to one another in operation.

According to another characteristic of the invention, each inter-vane spacer bears against the pressure side of the inner end of one vane and against the suction side of the inner end of an adjacent vane. The spacers also bear against the rings of the inner shroud and serve to occupy the inter-vane spaces inside the annular cavity, thereby serving in particular to prevent air from flowing in those spaces.

In operation, because the spacers present greater thermal expansion than the vanes and the shrouds, the pressure exerted by the spacers on the parts increases. This pressure nevertheless allows the parts of the stator stage to move relative to one another, and in particular allows the radially inner ends of the vanes to slide in the radial direction between the spacers, as a result of differential expansion.

Advantageously, each inter-vane spacer includes a first curved longitudinal edge that is convex for matching the shape of the pressure side of the inner end of a vane, and a second curved longitudinal edge that is concave for matching the shape of the suction side of the inner end of an adjacent vane. The spacers of the invention may be obtained by molding.

Preferably, in the stress-free state, the inter-vane spacers define an outside diameter that is greater than the outside diameter of the annular cavity defined by rings of the inner shroud, so that they are mounted in said cavity with prestress in the circumferential direction. This serves to ensure a good mechanical connection between the vanes and the inner shroud.

The rings of the inner shroud may be fastened to one another by nut-and-bolt type means. The inner shroud thus has the advantage of being easily dismantled, and its inner ring may be removed by undoing the nut-and-bolt type means, so as to have access to the inter-vane spacers, e.g. in order to replace them.

The inner ends of the vanes are designed to pass through the orifices in the outer ring of the inner shroud with clearance. The clearance between the inner ends of the vanes and the edges of said orifices may be occupied by injecting a polymerizable adhesive or resin or by beads of material carried by the inter-vane spacers. It is possible to occupy this clearance by injecting a polymerizable adhesive or resin that withstands high temperatures (higher than 300° C.), since the thickness of resin that is injected is relatively small.

The present invention also provides an inter-vane spacer for a stator stage of a turbomachine, as described above, the spacer being made of a perfluoroelastomer and having a first curved longitudinal edge that is concave for matching the shape of the suction side of a vane, and a second curved longitudinal edge that is convex for matching the shape of the pressure side of an adjacent vane.

The invention also provides a method of assembling a turbomachine stator stage as described above, wherein the method comprises the steps consisting in:

a) engaging the radially outer ends of the vanes in orifices of the outer shroud, and engaging the radially inner ends of the vanes in orifices in the outer ring of the inner shroud;

b) welding the outer ends of the vanes to the outer shroud;

c) mounting the inter-vane spacers between the inner ends of the vanes, inside the outer ring of the inner shroud; and d) fitting the inner ring of the inner shroud inside the outer ring and fastening it to said outer ring by nut-and-bolt type means.

The inter-vane spacers may be adhesively-bonded to the outer ring of the inner shroud during step c), in order to make it easier to assemble the spacers.

BRIEF DESCRIPTION OF THE DRAWINGS

The present invention can be better understood and other details, characteristics, and advantages of the present invention appear more clearly on reading the following description of a non-limiting example given with reference to the accompanying drawings, in which.

MORE DETAILED DESCRIPTION

Figure 1:
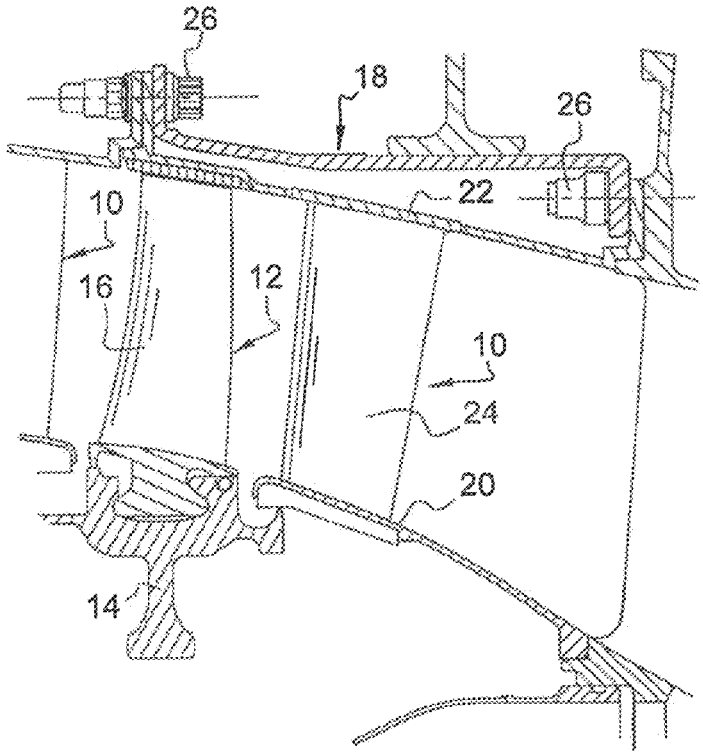
FIG. 1 is a fragmentary diagrammatic half-view in axial section of a turbomachine compressor including a prior art stator stage.

Reference is made initially to FIG. 1, which shows a low pressure compressor of a turbomachine such as an airplane turboprop or turbojet, the compressor comprising stator stages 10 with rotor blade stages 12 mounted between them.

Each rotor blade stage 12 comprises a disk 14 carrying, at its periphery, an annular row of substantially radial blades 16 surrounded by a casing 18 of the compressor.

Each stator stage 10 comprises two shrouds, respectively an inner shroud 20 and an outer shroud 22, with an annular row of substantially radial vanes 24 extending therebetween, the outer shroud 22 being fastened to the casing 18 by nut-and-bolt type means 26.

In the prior art, the radially outer ends of the vanes 24 are welded to the outer shroud 22. The radially inner ends of the blades 24 are engaged with clearance in orifices in the inner shroud 20 and they are secured to said inner shroud 20 by injecting a sealing resin for occupying the clearance between the inner ends of the vanes and the edges of the orifices in the inner shroud.

However, as explained above, the sealing resin, which is injected directly onto the radially inner ends of the blades, presents relatively poor high-temperature performance.

The invention provides a solution to this problem by providing mechanical connection means between the radially inner ends of the vanes and the inner shroud that withstand high temperatures (higher than 300° C.) and that have thermodynamic, sealing, and vibration-damping properties that are similar to those of a sealing resin in the prior art.

Figure 2:
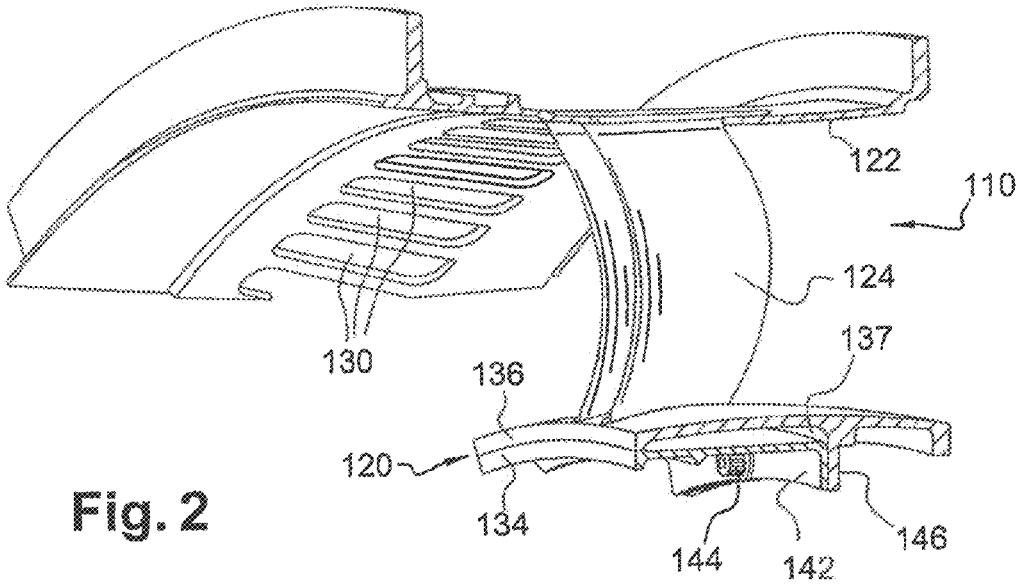
FIG. 2 is a fragmentary diagrammatic view in perspective of a stator stage of the invention.
Figure 3:
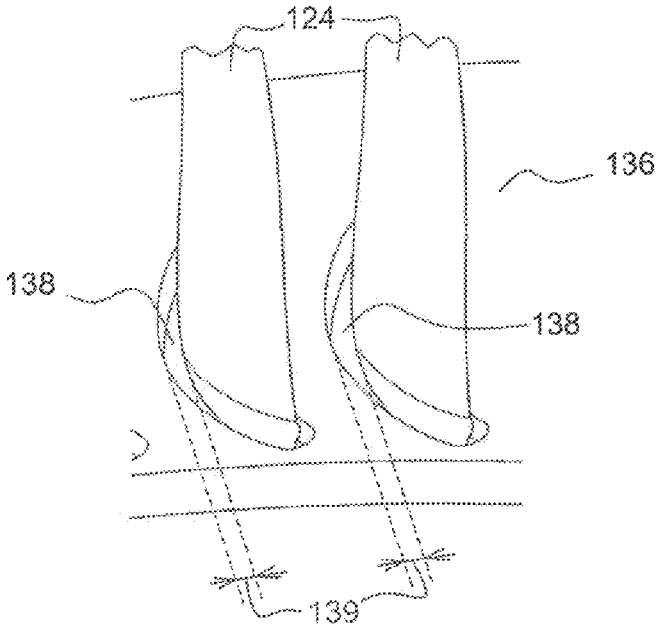
FIG. 3 is a fragmentary diagrammatic view in perspective of the inner shroud and of the vanes of the FIG. 2 stator stage.
Figure 4:
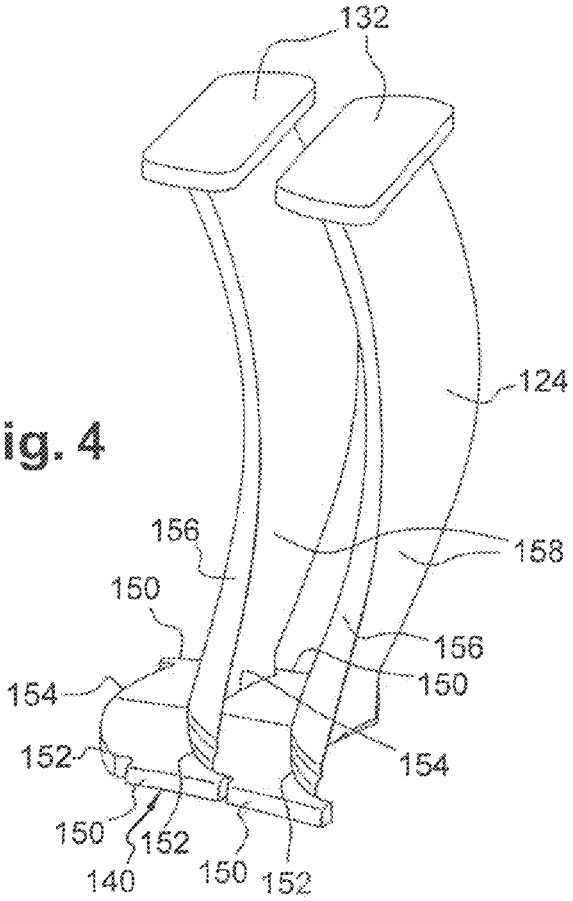
FIG. 4 is a diagrammatic view in perspective of two vanes and two inter-vane spacers of the FIG. 2 stator stage.

In the embodiment of the invention shown in FIGS. 2 to 4, the radially outer ends of the vanes 124 are welded to the outer shroud 122, and inter-vane spacers 140 are mounted between their radially inner ends in an annular cavity of the inner shroud, while bearing circumferentially against the ends of the vanes.

The outer shroud 122 of the stator stage 110 shown in FIG. 2 has a plurality of through radial orifices 130 of substantially rectangular shape that are elongate in the longitudinal direction.

Each vane 124 is secured at its radially outer end to a platform 132 of a shape that is complementary to the shape of the above-mentioned orifices in the outer shroud 122 (FIG. 4). The platform 132 of each vane is engaged in a respective orifice 130 of the outer shroud 122 and is welded to said shroud, e.g. by means of a weld bead that extends along the edge of the orifice 130 (FIG. 2).

The inner shroud 120 of the stator stage 110 comprises two coaxial rings 134 and 136, one extending inside the other and together defining between them an annular cavity 137 for housing the inter-vane spacers 140 (FIG. 2).

The outer ring 136 of the inner shroud 120, visible in FIGS. 2 and 3, includes radial orifices 138 through which the radially inner ends of the vanes pass so as to extend into the above-mentioned annular cavity 137. Assembly clearance 139 is provided between the inner ends of the vanes and the edges of the orifices 138 in the ring 136 so as to enable the stator stage to be assembled.

The inner ring 134 extends inside the outer ring 136 and inside the vanes 124, and serves to close the cavity 137. It does not have any orifices for passing vanes, with the radially inner ends of the vanes being situated close to the outer surface of the ring 134.

At its downstream end, the ring 134 has a radially inner annular flange 142 that is pressed against and fastened to a radially inner annular flange 146 of the outer ring 136 by nut-and-bolt type means 144. Fastening the rings of the inner shroud 120 together in this way allows the shroud to be disassembled, e.g. in order to change the inter-vane spacers 140.

The inter-vane spacers 140 extend in the cavity 137 between the inner and outer rings 134 and 136. Each spacer 140 is interposed between the radially inner ends of two adjacent vanes 124 (FIG. 4). The number of spacers is the same as the number of vanes in the stator stage, and for example it is equal to about 100.

Each spacer 140 is molded out of an elastically deformable material of the elastomer type that withstands temperatures higher than 300° C. The spacers 140 are advantageously made of a perfluoroelastomer, e.g. that which is sold by the supplier DuPont de Nemours under the name Kalrez® 7075 or by the supplier Trelleborg under the name Isolast® 8325, both of those two compositions withstanding temperatures that may be as high 320° C. In applications where operating temperatures are lower, the spacers may be made of silicone elastomer, fluorosilicone, fluorocarbon, rubber, etc. This type of material is well known for applications that require sealing and it is used here in an application that requires spacing and damping.

Each spacer 140 has two rectilinear transverse edges 150 that are connected together by two curved longitudinal edges, respectively a concave edge 152 and a convex edge 154.

The concave longitudinal edge 152 of each spacer 140 is of a shape that is complementary to the suction side 156 of the radially inner end of a vane and is designed to bear against said suction side. The convex longitudinal edge 154 of each spacer is of a shape that is complementary to the pressure side 158 of the radially inner end of a vane, and it is designed to bear against the pressure side.

The spacers 140 define an outside diameter that is greater than the outside diameter of the cavity 137 such that they are mounted inside the cavity 137 with prestress in the circumferential direction, and they are lightly compressed in said direction between the radially inner ends of the vanes.

The stator stage 110 of FIGS. 2 to 4 may be assembled as follows: the outer ring 136 of the inner shroud 120 is placed inside the outer shroud 122. When the outer shroud 122 and/or the outer ring 136 are sectorized, then their sectors are disposed circumferentially end to end. The vanes 124 are placed between the outer shroud 122 and the outer ring 136 by inserting their radially outer ends in the orifices 130 of the outer shroud and their radially inner ends in the orifices 138 of the outer ring. The above-mentioned clearances 139 between the inner ends of the vanes and the edges of the orifices in the outer ring are optimized to make such assembly possible. The radially outer ends of the vanes are welded to the outer shroud. The inter-vane spacers 140 are mounted inside the outer ring 136 between the radially inner ends of the vanes, and they are optionally adhesively bonded to a radially inner surface of the ring 136. The inner ring 134, which may also be sectorized, is then mounted inside the outer ring 136 and is fastened to said ring, preferably by bolting.

In a variant that is not shown, the above-mentioned clearances 139 between the inner ends of the vanes and the edges of the orifices in the outer ring (FIG. 3) may be occupied by injecting a small thickness of polymerizable sealing resin, such as a silicone-based resin, for example.

In another variant, these clearances may be occupied by beads of material from the inter-vane spacers, each spacer then including a first bead extending along its concave curved longitudinal edge for inserting between the suction side of a vane and the edge of the orifice in the shroud situated facing said suction side, and a second bead extending along its convex longitudinal edge so as to be inserted between the pressure side of a vane and the edge of the orifice in the shroud that is situated facing said pressure side.

What is claimed is:

1. A stator stage of a turbomachine compressor, the stage comprising:

an inner shroud and an outer shroud coaxial with the inner shroud; and substantially radial vanes extending between the inner and outer shrouds with radially outer ends of the vanes being welded to the outer shroud and with radially inner ends of the vanes being secured to the inner shroud, wherein the inner shroud comprises inner and outer rings which are coaxial and fastened one inside the other, the outer ring having orifices for passing the inner ends of the vanes and co-operating with the inner ring to define an annular cavity for housing inter-vane spacers for providing sealing and for damping vibration, each of which spacers is mounted between the radially inner ends of two adjacent vanes, each of said vanes having a suction side and a pressure side, wherein each inter-vane spacer includes a first curved longitudinal edge that is convex and matches the shape of the pressure side of the radially inner end of a first one of said vanes, and a second curved longitudinal edge that is concave and matches the shape of the suction side of the radially inner end of a vane adjacent to said first one of said vanes, and wherein the inter-vane spacers are made of an elastomer that is adapted to withstand a temperature of at least 300° C.

2. A stator stage according to claim 1, wherein the inter-vane spacers bear against the rings of the inner shroud.

3. A stator stage according to claim 1, wherein, in a stress-free state, the inter-vane spacers define an outside diameter that is greater than an outside diameter of the annular cavity defined by rings of the inner shroud, so that the inter-vane spacers are mounted in said cavity with prestress in a circumferential direction.

4. A stator stage according to claim 1, wherein the rings of the inner shroud are fastened to one another by nut-and-bolt type fasteners.

5. A stator stage according to claim 1, wherein the radially inner ends of the vanes pass through the orifices of the outer ring with clearance, the clearances between the radially inner ends of the vanes and the edges of these orifices being occupied by a polymerizable adhesive or resin or by beads of material carried by the inter-vane spacers.

6. An inter-vane spacer as a wedge for propping a first vane and a second vane of a turbomachine stator stage according to claim 1, each of said vanes having a convex suction side and a concave pressure side, wherein the spacer is adapted to be inserted between said first and second vanes, is made of a perfluoroelastomer and has a first curved longitudinal edge that is concave and shaped for matching the suction side of the first vane, and a second curved longitudinal edge that is convex and shaped for matching the pressure side of the second vane.

7. A method of assembling a stator stage according to claim 1, wherein the method comprises:

a) engaging the radially outer ends of the vanes in orifices of the outer shroud, and engaging the radially inner ends of the vanes in orifices in the outer ring of the inner shroud;

b) welding the outer ends of the vanes to the outer shroud;

c) mounting each inter-vane spacer between the radially inner ends of two successive vanes, inside the outer ring of the inner shroud, so that a concave longitudinal edge of one of said inter-vane spacers is matching the convex suction side of a first one of the vanes, and a convex longitudinal edge of said inter-vane spacer is matching the concave pressure side of the vane adjacent to said first one of said vanes; and d) fitting the inner ring of the inner shroud inside the outer ring and fastening said inner ring to said outer ring by nut-and-bolt type fasteners.

8. A method according to claim 7, wherein the inter-vane spacers are adhesively-bonded to the outer ring of the inner shroud during step c).

9. A stator stage of a turbomachine compressor, the stator stage comprising:

an inner shroud and a coaxial outer shroud; and substantially radial vanes extending between the inner and outer shrouds, said vanes having radially outer ends welded to the outer shroud and radially inner ends secured to the inner shroud by sealing and vibration-damping means, wherein the inner shroud comprises an inner ring and a coaxial outer ring fastened one inside the other, the outer ring having orifices through which pass the radially inner ends of the vanes and defining with the inner ring an annular cavity housing inter-vane spacers for providing sealing and for damping vibration, the inter-vane spacers having a stress-free state in which said inter-vane spacers define an outside diameter that is greater than an outside diameter of an annular cavity defined by the inner and outer rings, so that said inter-vane spacers are mounted in said cavity with a prestress in a circumferential direction.

10. A stator stage according to claim 9, wherein each inter-vane spacer is mounted between the radially inner ends of two of said vanes which are adjacent one with respect to the other, and each inter-vane spacer bears against said radially inner ends.

11. A stator stage according to claim 9, wherein each of said vanes has a convex suction side and a concave pressure side, and each inter-vane spacer bears against the pressure side of the radially inner end of one of said vanes and against the suction side of the radially inner end of another of said vanes which is adjacent to said one vane.

12. A stator stage according to claim 9, wherein each inter-vane spacer includes a first curved longitudinal edge that is convex for matching the shape of the pressure side of the inner end of a vane, and a second curved longitudinal edge that is concave for matching the shape of the suction side of the inner end of an adjacent vane.

13. A stator stage according to claim 9, wherein the inter-vane spacers are molded out of an elastomer that is capable of withstanding temperatures of at least 300° C.

* * * * *